US005339711A

United States Patent [19]

Shu

[11] Patent Number: 5,339,711

[45] Date of Patent: Aug. 23, 1994

[54] RATCHET SCREW DRIVER

[76] Inventor: Zu-Shung Shu, No. 11, Lane 11-1, Guo Chong Road, Da Lie Hsiang, Taichung, Taiwan

[21] Appl. No.: 89,939

[22] Filed: Jul. 12, 1993

[51] Int. Cl.[5] ..... B25B 13/46

[52] U.S. Cl. ..... 81/63; 81/63.2

[58] Field of Search ..... 81/63, 63.2

[56] References Cited

U.S. PATENT DOCUMENTS 4,901,607 2/1990 Beugelsdyk et al. ..... 81/63.2

5,142,953 9/1992 Lin ..... 81/63

*Primary Examiner*—James G. Smith

*Attorney, Agent, or Firm*—Charles E. Baxley

[57] ABSTRACT

A ratchet screw driver includes a housing, a pinion rotatably engaged in the housing, a sleeve rotatably engaged on the housing and engaged with the pinion in order to rotate the pinion, a shaft rotatably received in the housing, a notch formed in the shaft for receiving a pawl, a rod having a gear engaged with the pinion and having a projection for engaging with the pawl in order to rotate the pawl, the pawl is rotated when the rod is rotated by the sleeve via the pinion.

3 Claims, 1 Drawing Sheet

RATCHET SCREW DRIVER

BACKGROUND OF THE INVENTION (a) Field of the Invention

The present invention relates to a screw driver, and more particularly to a ratchet screw driver.

(b) Description of the Prior Art

A typical ratchet screw driver is disclosed in U.S. Pat. No. 5,142,953 to Lin and comprises a post extended through a notch formed in the shaft so as to rotate the shaft and in order to rotate the pawl, and so as to change the active directions of the ratchet screw driver; in this patent, it is difficult to form the indent in the head in order to receive the pawl, furthermore, the pawl can not be easily engaged in the indent such that the operators may waste much time to locate and to assemble the pawl, the pin for positioning the pawl can not be easily engaged in place, in addition, the notch should be formed in the shaft such that the post may extend and may be engaged with the rod, the notch greatly reduces the strength of the shaft and greatly weaken the shaft such that the working life of the screw driver is greatly decreased, and such that this kind of screw driver can not be commercialized.

The present invention has arisen to mitigate and/or obviate the afore-described disadvantages of the conventional ratchet screw drivers.

SUMMARY OF THE INVENTION

The primary objective of the present invention is to provide a ratchet screw driver which includes a shaft within which no notches are required to be formed and the strength thereof will not be decreased.

In accordance with one aspect of the present invention, there is provided a ratchet screw driver comprising a housing including a space formed in an inner and lower portion thereof, an opening formed in a middle portion of the housing and communicated with the space, a pinion rotatably supported in the opening, a sleeve rotatably engaged on the housing and engaged with the pinion in order to rotate the pinion, a plurality of first teeth formed in the space, a shaft rotatably received in the space and including a bore, a notch formed therein and communicated with the bore, a pawl rotatably supported in the notch of the shaft and including two ends each having at least one second teeth engageable with the first teeth of the housing, a rod including a lower portion rotatably engaged in the bore of the shaft and including a gear formed thereon for engaging with the pinion such that the rod is rotated when the sleeve is rotated, and a projection engaged in the lower portion of the rod and engaged with the pawl in order to rotate the pawl when the rod is rotated, whereby, either of the second teeth of the pawl is caused to engage with the first teeth when the rod is rotated.

Further objectives and advantages of the present invention will become apparent from a careful reading of the detailed description provided hereinbelow, with appropriate reference to the accompanying drawings.

DETAILED DESCRIPTION OF THE INVENTION

Figure 6:
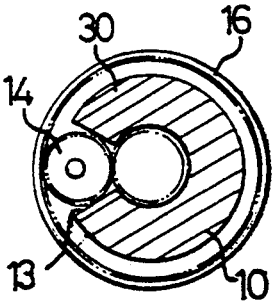
FIG. 6 is a cross sectional view taken along lines 6—6 of FIG. 3.

Referring to the drawings, and initially to FIGS. 1 to 4, a ratchet screw driver in accordance with the present invention comprises generally a housing 10 including an extension 11 extended upward therefrom for coupling to a handle (not shown), a hollow space 12 (FIG. 3) formed in the lower portion thereof, a opening 13 formed in the middle portion of the housing 10 and communicated with the space 12, a pinion 14 rotatably supported in the opening 13 by a pin 15, a sleeve 16 engaged on the housing 10 and having a plurality of teeth 17 formed in the inner peripheral portion thereof for engaging with the pinion 14 such that the pinion 14 can be rotated by the sleeve 16, and a number of teeth 19 axially formed in the peripheral portion of the space 12. It is to be noted that, as best shown in FIG. 6, the opening 13 has a size corresponding to that of the pinion 14 and arranged such that the pinion 14 can be easily positioned in place without trial and error processes.

A shaft 20 is rotatably received in the space 12 and includes a bore 22 formed therein, a notch 21 formed in the shaft 20 and communicated with the bore 22, a pair of curved ribs 23 extended upward from the shaft 20, a disc 24 includes a pair of curved slots 25 formed therein for engaging with the ribs 23 by such as force-fitted engagement such that the disc 24 can be retained in place and will not rotate relative to the shaft 20, the disc 24 includes a hole 26 aligned with the bore 22 of the shaft 20, a pawl 27 is rotatably supported in the notch 21 by a pin 28 which can be easily engaged between the disc 24 and the shaft 20, a washer 36 is disposed above disc 24, and a rod 30 has a lower portion rotatably engaged in the hole 26 of the disc 24 and in the bore 22 of the shaft 20, a projection including a spring 33 and a ball 34 is received in the lower portion of the rod 30 in which the ball 34 is biased outward of the rod 30 in order to engage with the pawl 27 and in order to position the pawl 27, the rod 30 includes a stub 31 formed in the upper portion for rotatably engaging in the housing 10 and includes a gear 32 formed in the middle portion thereof for engaging with the pinion 14 such that the rod 30 can be rotated by the sleeve 16.

Figure 4:
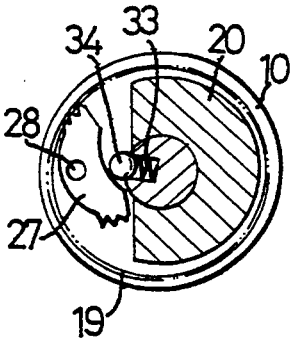
FIGS. 4 and 5 are cross sectional views taken along lines 4—4 of FIG. 3, illustrating the operations of the pawl.
Figure 5:
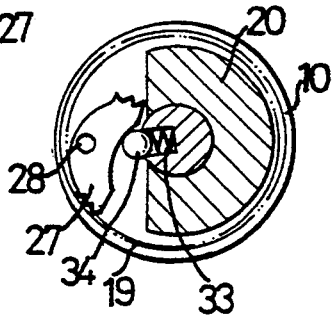

Referring next to FIGS. 4 and 5, the pawl 27 includes two ends each having at least one tooth formed therein, when the rod 30 is rotated by the sleeve 16, the pawl 27 is caused to be rotated by the ball 34 and the spring 33 such that either of the ends of the pawl 27 is caused to engage with the teeth 19 of the housing 10 such that the acting directions of the ratchet screw driver can be adjusted.

Figure 1:
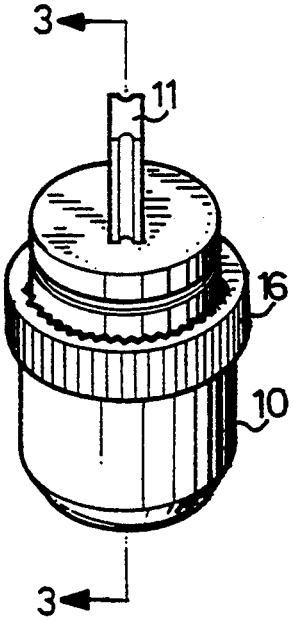
FIG. 1 is a perspective view of a ratchet screw driver in accordance with the present invention.
Figure 2:
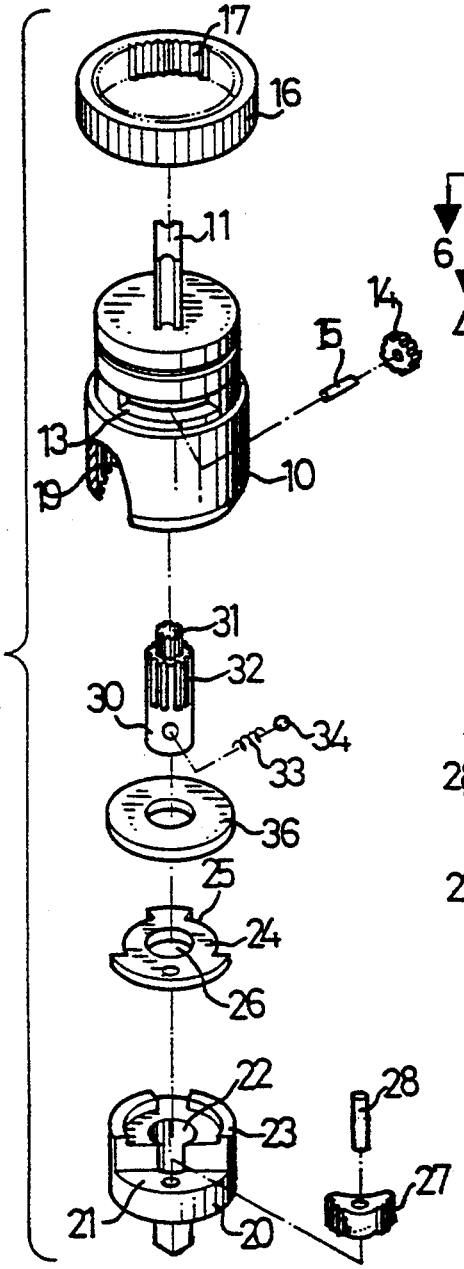
FIG. 2 is an exploded view of the ratchet screw driver.
Figure 3:
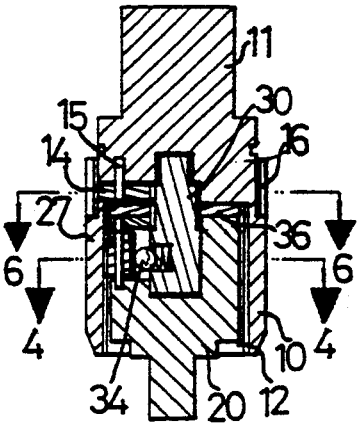
FIG. 3 is a cross sectional view taken along lines 3–3 of FIG. 2.

As best shown in FIG. 3, the washer 36 is disposed between the pinion 14 and the disc 24 such that the pins 15 and 28 are supported in place by the washer 36, the pins 15 and 28 are thus prevented from moving along the axial direction of the housing.

Accordingly, the ratchet screw driver in accordance with the present invention includes a mechanism for effectively switching the acting directions of the ratchet screw driver, the rod 30 can be rotated by the sleeve 16 via the pinion 14, in addition, the pin 28 can be easily engaged in place because the disc 24 is a separate piece from the shaft 20, the notch 21 can also be easily machined.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet screw driver comprising a housing including a space formed in an inner and lower portion thereof, an opening formed in a middle portion of said housing and communicated with said space, a pinion rotatably supported in said opening, a sleeve rotatably engaged on said housing and engaged with said pinion in order to rotate said pinion, a plurality of first teeth formed in said space, a shaft rotatably received in said space and including a bore, a notch formed therein and communicated with said bore, a pawl rotatably supported in said notch of said shaft and including two ends each having at least one second teeth engageable with said first teeth of said housing, a rod including a lower portion rotatably engaged in said bore of said shaft and including a gear formed thereon for engaging with said pinion such that said rod is rotated when said sleeve is rotated, and a projection engaged in said lower portion of said rod and engaged with said pawl in order to rotate said pawl when said rod is rotated, whereby, either of said second teeth of said pawl is caused to engage with said first teeth when said rod is rotated.

2. A ratchet screw driver according to claim 1, wherein said shaft includes at least one rib extended upward therefrom, a disc engaged on top of said shaft and having at least one slot formed therein for engaging with said rib so as to prevent said disc from rotating relative to said shaft, said disc including a hole formed therein and aligned with said bore of said shaft, said lower portion of said rod is rotatably engaged in said hole of said disc and in said bore of said shaft.

3. A ratchet screw driver according to claim 2 further comprising a washer disposed between said pinion and said disc, a first pin engaged in said pinion so as to rotatably support said pinion in said opening, a second pin engaged in said pawl for rotatably supporting said pawl in place, said first pin and said second pin being engaged with said washer such that said first pin and second pin are stably supported in place.

* * * * *